United States Patent [19]

Finger et al.

[11] 4,289,331

[45] Sep. 15, 1981

[54] COMPILER-BINDER FOR PERIODICALS AND THE LIKE

[76] Inventors: Alexander E. Finger; Fay Finger, both of 52 County Rd., Chelsea, Mass. 02150

[21] Appl. No.: 54,163

[22] Filed: Jul. 2, 1979

[51] Int. Cl.[3] ..... B42D 1/06; B42F 13/00; B42F 1/00

[52] U.S. Cl. ..... 281/47; 24/67 R; 402/75; 402/80 R

[58] Field of Search ..... 281/15 R, 15 A, 21 R, 281/26, 29, 34, 42, 45–47; 402/75, 80 P, 500, 502, 19, 20, 21, 37; D3/48–53; 24/67 R, 67 AR, 67.7, 73, 259 FS; 248/441, 441 A, 441 B, 441 C, 441 D

[56] References Cited

U.S. PATENT DOCUMENTS

| | | | |
|---|---|---|---|
| 3,353,844 | 11/1967 | Staats | 492/75 |
| 3,570,071 | 3/1971 | Wardell | 24/67 R |
| 3,909,141 | 9/1975 | Staats | 402/80 R X |

*Primary Examiner*—Paul A. Bell
*Assistant Examiner*—John S. Brown
*Attorney, Agent, or Firm*—Rines and Rines, Shapiro and Shapiro

[57] ABSTRACT

This disclosure involves a compiler-binder having a rigid back spine and covers hinged thereto, wherein the spine is provided with transverse openings for receiving projections of clips securable to the backs of each of a plurality of periodicals to lock the same against vertical movement and effectively bind them in a manner closely simulating a rigidly bound book with a hard board cover, without the necessity for resorting to customary bookbinding techniques.

10 Claims, 12 Drawing Figures

COMPILER-BINDER FOR PERIODICALS AND THE LIKE

The present invention relates to compiler-binders for accumulating periodicals and other similar publications and materials, being more particularly directed to storing such materials in a manner that simulates a hard-bound book, with the materials maintained in place but adapted to be opened and used as if the book were hard-bound, and with adaptability for the stored material to be bound permanently into position or to be removed individually from the binder at will.

Various types of binding techniques have heretofore been proposed and/or employed throughout the years to facilitate accumulation, storage and retrieval use of periodicals and publications and similar materials, hereinafter generically referred to as "periodicals and the like". Included in such prior-art techniques have been the use of metal clamps attached to a spine as embodied, for example, in U.S. Pat. No. 3,540,832, and dove-tailed tracks upon which a slotted publication may be attached, as disclosed in early U.S. Pat. No. 321,142, (1885). The slotting of publications is also taught in U.S. Pat. Nos. 2,891,554 and 639,420 (1899). The use of clamps, broadly, to affix publications to the spine of a binder has also been heretofore proposed as in U.S. Pat. Nos. 3,752,503; 2,271,734; 1,793,076; and 716,363 (1902). The assembly embodied in U.S. Pat. No. 2,127,619, as another example, destroys the integrity of the publications to be accumulated and affixes the same to the spine of the binder by sliding dove-tailed publication-carried projections longitudinally along a channel in a manner that does not lock the publications against vertical movement, as when pages are really bound in a book. The book cover embodied in the early U.S. Pat. No. 624,195 (1899), as still another illustration, must employ a flexible spine that is not in the same plane or coextensive with the cover when the book cover is open.

Despite these many proposals dating back at least to the late 1800's, such prior techniques have all been subject to such disadvantages as requiring one or more of heavy, bulky binders unlike normal books, or the use of accessory devices to slot the periodical (s)—a process that is difficult and time-consuming and results in the cutting or penetration of the publication(s), thereby destroying their wholeness and integrity—and they do not provide a binding that gives all of the advantages of, and effectively simulates an actual hard-bound book.

As a result of these deficiencies, it is still the widespread practice of users to put up with the disadvantages and expense of accumulating the loose periodicals and occasionally sending the same to a book bindery to have them sewn or glued together in a book cover, losing access to the same during that process.

An object of the present invention, accordingly, is to provide a new and improved compiler-binder for periodicals and the like that shall not be subject to the above-discussed disadvantages of prior art techniques, but, to the contrary, effectively simulates a hard-bound book and serves as such.

A further object is to provide such a novel compiler-binder employing symmetrically disposed slots on a rigid planar spine coextensive with the binder covers and that remains rigid and is in the same plane as the covers when the binder is opened, to facilitate the immediate access to an orderly accumulation of stored periodicals that remain in place and permit access as if truly book-bound.

An additional object is to provide a novel binder that is inexpensive and extremely versatile in binding application.

Other and further objects are hereinafter set forth and are more particularly delineated in the appended claims.

In summary, from one of its important aspects, the invention embodies a compiler-binder for periodicals and the like comprising a rigid back spine and covers hinged thereto, the spine being provided on its inner surface with a pair of symmetrically disposed vertically spaced transversely extending opening means for receiving projections, clip means securable to the back of said periodicals and the like to be bound within the covers and having a pair of rearwardly protruding integral projections vertically spaced for reception within the pair of transverse opening means, and means provided on one of the opening means and the projections, for locking said periodicals against vertical movement when the latter are inserted in the opening means whereby the spine facilitates the binding of periodicals simulating a rigidly bound book. Preferred constructional details and modifications are hereinafter presented.

The invention will now be described in connection with the accompanying drawings, in which FIG. 1 is a perspective view of an open compiler-binder, constructed in accordance with the invention, prior to receiving periodicals and the like;

FIG. 2 is a similar view of the periodical prepared for insertion into the binder of FIG. 1 with the aid of an adhesive clip;

FIG. 3 details the type of projections of the clip of FIG. 2;

Figure 5:
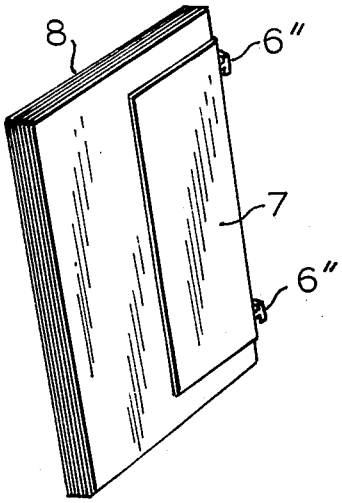
FIG. 5 is a view similar to FIG. 2 illustrating projections attached to a periodical by an adhesive clip particularly appropriate for insertion in the binder of FIG. 4.
Figure 6:
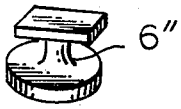
Figure 7:
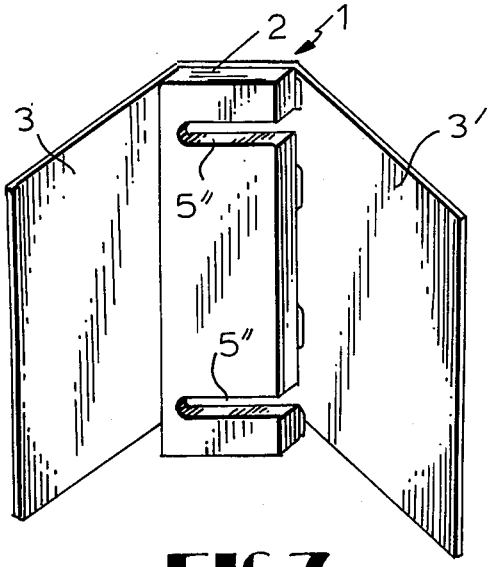
Figure 10:
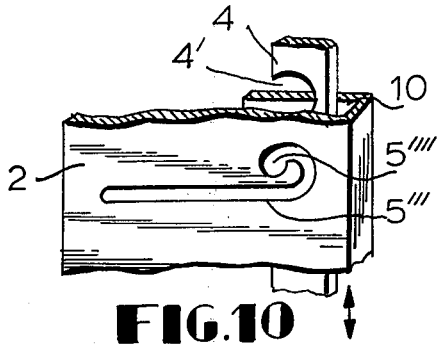
Figure 9A:
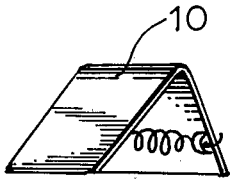
Figure 11:
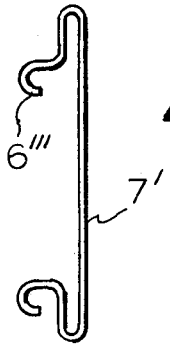
Figure 9B:
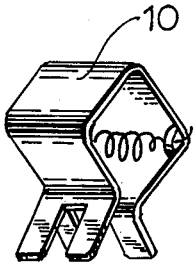
Figure 8:
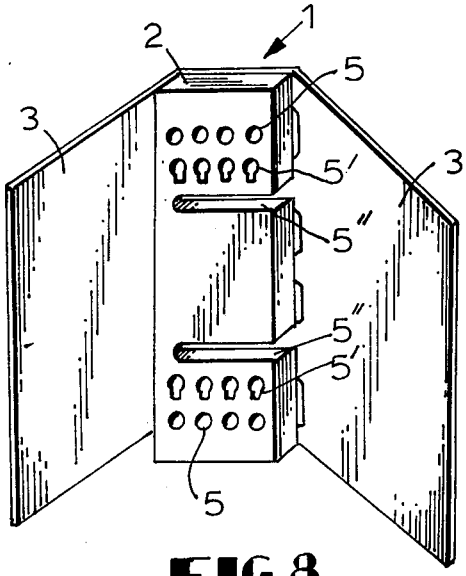

FIG. 6 details the projections used in the system of FIG. 5;

FIG. 8 is a perspective view of still a further modified compiler-binder, absent the periodical(s), and using a combination of circular, keyhole and channel openings;

FIGS. 9*a* and *b* are perspective views of illustrative channel locking devices, useful in the various embodiments of the invention;

FIG. 10 is a fragmentary view similar to FIG. 7 of further modification with a self-locking channel feature; and FIG. 11 is an elevation of a modified clip particularly adapted for use with saddle-stitched publications and the like.

Figure 1:
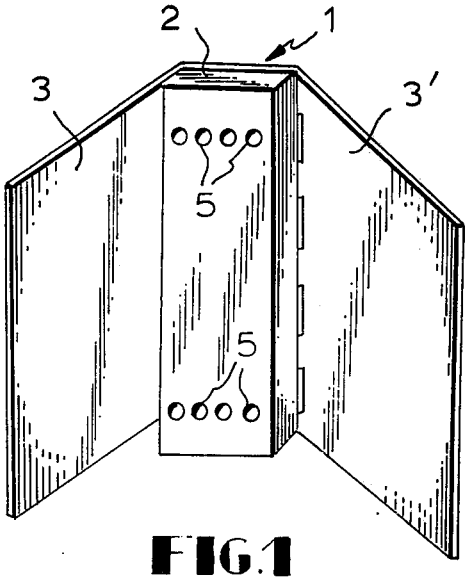
Figure 2:
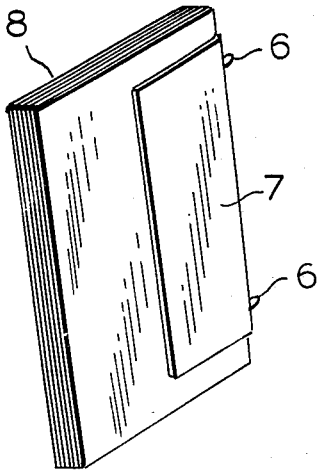

Referring to the drawings, a rigid spine 1 is illustrated in FIG. 1 secured to the back 2 of the binder, the longitudinal edges of which are hingedly connected to front and back covers 3 and 3' as in a conventional book. The spine 1 is provided on its inner surface with a pair of preferably symmetrically disposed, vertically spaced transversely extending openings, shown in FIG. 1 in the form of lines of successive circular holes 5, positioned near the opposite upper and lower edges of the spine 1. The holes 5 are dimensioned to receive a pair of projections 6 integral with a clip 7, FIG. 2, and adapted to receive and attach to an intermediate region of a periodical or the like 8. The clip 7 may be provided with an inner adhesive coating for adhering to the outer paper of the publication as shown, or it may be otherwise attached thereto. The pair of projections 6 are vertically spaced to correspond to the vertical separation of the parallel lines of holes 5. In the form illustrated in FIGS. 2 and 3, the enlarged head 6' of each projection 6 is slightly tapered to facilitate forced-entrance into a particular free set of upper and lower holes 5, depending upon how many periodicals have earlier been inserted. This tapering is desired because the overall diameter or cross section of the projection head is preferably slightly larger than the circular opening 5, so that once the projection 6 has been fitted into the circular hole, the enlarged projection head cannot fall out or readily be withdrawn and the periodical is locked against vertical movement in the binder. The periodicals in this form of the invention, indeed, are now substantially permanently affixed to the spine of the compiler-binder, and may be used in a manner that simulates a rigidly hard-bound book, with the pages freely turnable in sequence, laying open without gaps, and closing tightly in conventional bound fashion.

Figure 4:
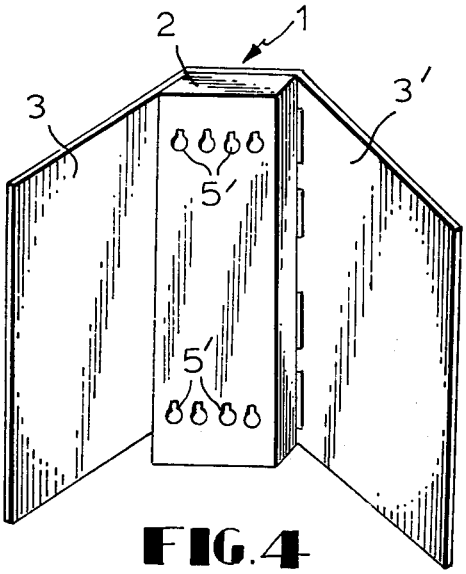
FIGS. 4 and 7 are views similar to FIG. 1 of modified binder constructions employing keyhole type and channel type openings, respectively.
Figure 3:
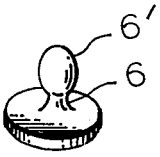

In the modification of FIG. 4, a keyhole configuration 5' is provided which may also be used with the tapered projections of FIG. 3. Such projections 6-6' from the clip 7 are fitted into the large opening of the keyhole 5', and are moved upward toward the smaller portion to lock the periodicals in the spine. In this case, however, the periodical, while attached to the spine of the compiler-binder and held from vertical movement in normal use, may be readily removed, if desired, by unlocking downward disengagement. If desired, the keyhole openings 5' may be inverted so that periodical locking is effected by downward movement into the smaller keyhole portions; and removal, by upward movement, as more particularly shown in the embodiment of FIG. 8.

The modified channel configurations 5'' of the transversely extending spine openings of FIG. 7 is adapted to receive a clip projection of the type shown in FIGS. 5 and 6 at 6'', inserted or fitted into the channels at their open ends and moved transversely or laterally inward to the desired location. The periodical(s) may be locked in a fixed position within the channels by end elements 10 or 10', FIGS. 9*a* and *b*, which are spring compressible for sliding insertion into each channel 5''. These locking devices may be readily removed to allow placement of additional periodicals within the channels and then replaced to lock the same against lateral movement.

In the further embodiment of FIG. 8, a multi-compiler-binder is illustrated that provides the option for using any one of the three before-described binding opening constructions 5, 5' and 5'', or any combination thereof; and in the modification of FIG. 10, the slots 5''' are further shaped to embody integral reverse-curve terminations 5'''' into which the projections 6, etc. may be inserted upon alignment with a C-shaped aperture 4' in a locking bar 4, the bar being slidably mounted in a rearward channel 10 to lock the termination 5'''' after such insertion.

While the clip 7 has been shown adhesively applied to the outside of the periodical in preferred form, it may be modified to be of spring metal or resilient plastic to clip upon the periodical; or, particularly in the case of saddle-stitched periodicals and the like, in may even assume the form shown in FIG. 11 of a wire clip 7' running within or inside the periodical adjacent the back fold and extending over the top and bottom thereof down and adjacent the back ridge of the periodical, terminating in rearward projections 6'''.

Further modifications will also occur to those skilled in this art and such are considered to fall within the spirit and scope of the invention as defined in the appended claims.

What is claimed is:

1. A compiler-binder for periodicals and the like comprising a rigid back spine and covers hinged thereto, spaced opening means formed in said rigid spine in spaced relation to the opposite ends of the spine, the opening means comprising at least a pair of holes extending in the thickness direction of the spine for receiving projections, clip means securable to the back of said periodicals and the like to be bound within the covers and having a pair of rearwardly protruding integral projections spaced for reception within the opening means, and cooperative means provided on the opening means and the projections, for locking said periodicals against movement lengthwise and in the thickness direction of the spine when the latter are inserted in the opening means, whereby the spine facilitates the binding of periodicals simulating a rigidly bound book.

2. A compiler-binder as claimed in claim 1 wherein the opening means comprises lines of successive holes disposed near opposite ends of the spine and parallel to one another, and said projections are provided with enlarged heads for locking the same within the holes.

3. A compiler-binder for periodicals and the like comprising a rigid back spine and covers hinged thereto, the spine being provided on its inner surface with a pair of symmetrically disposed vertically spaced transversely extending opening means for receiving projections, clip means securable to the back of said periodicals and the like to be bound within the covers and having a pair of rearwardly protruding integral projections vertically spaced for reception within the pair of transverse opening means, and means provided on one of the opening means and the projections, for locking said periodicals against vertical movement when the latter are inserted in the opening means, whereby the spine facilitates the binding of periodicals simulating a rigidly bound book, wherein the transversely extending opening means comprises lines of successive keyhole-shaped apertures disposed near opposite ends of the spine and parallel to one another, the apertures receiving said projections through the larger portion of the keyhole-shaped aperture and locking the same within the smaller portion thereof.

4. A compiler-binder for periodicals and the like comprising a rigid back spine and covers hinged thereto, the spine being provided on its inner surface with a pair of symmetrically disposed vertically spaced transversely extending opening means for receiving projections, clip means securable to the back of said periodicals and the like to be bound within the covers and having a pair of rearwardly protruding integral projections vertically spaced for reception within the pair of transverse opening means, and means provided on one of the opening means and the projections, for locking said periodicals against vertical movement when the latter are inserted in the opening means, whereby the spine facilitates the binding of periodicals simulating a rigidly bound book, wherein the transversely extending opening means comprise channel slots disposed near opposite ends of the spine and parallel to one another, and said projections are provided with heads for locking within the slots.

5. A compiler-binder as claimed in claim 4 and in which said channel slots are provided with reversely curved terminal portions for holding said projections within the slots.

6. A compiler-binder as claimed in claim 5 wherein said locking means is integrated with the projections for locking the associated clip means within the slot means.

7. A compiler-binder as claimed in claim 1 wherein said projections are detachably secured within the opening means.

8. A compiler-binder for periodicals and the like comprising a rigid back spine and covers hinged thereto, the spine being provided on its inner surface with a pair of symmetrically disposed vertically spaced transversely extending opening means for receiving projections, clip means securable to the back of said periodicals and the like to be bound within the covers and having a pair of rearwardly protruding integral projections vertically spaced for reception within the pair of transverse opening means, and means provided on one of the opening means and the projections, for locking said periodicals against vertical movement when the latter are inserted in the opening means, whereby the spine facilitates the binding of periodicals simulating a rigidly bound book, and in which said transversely extending opening means comprise channel slots and said locking means comprise detachable elements slidable within the slots.

9. A compiler-binder as claimed in claim 1 and in which said clip means is provided with means for adhesively securing the same to the back of said periodicals and the like.

10. A compiler-binder for periodicals and the like comprising a rigid back spine and covers hinged thereto, the spine being provided on its inner surface with a pair of symmetrically disposed vertically spaced transversely extending opening means for receiving projections, clip means securable to the back of said periodicals and the like to be bound within the covers and having a pair of rearwardly protruding integral projections vertically spaced for reception within the pair of transverse opening means, and means provided on one of the opening means and the projections, for locking said periodicals against vertical movement when the latter are inserted in the opening means, whereby the spine facilitates the binding of periodicals simulating a rigidly bound book, and in which said clip means comprises wire-like means for insertion within the periodical adjacent the back thereof and extending over the top and bottom thereof down and adjacent the back, terminating in said rearwardly protruding projections.

* * * * *